United States Patent [19]

Winter et al.

[11] 4,259,270

[45] Mar. 31, 1981

[54] APPARATUS AND METHOD FOR THE MANUFACTURE OF SPLAT FOILS FROM METALLIC MELTS

[75] Inventors: Heinrich Winter, Eschborn; Dietrich Merz, Kelkheim, both of Fed. Rep. of Germany

[73] Assignee: Battelle-Institut e.V., Frankfurt am Main, Fed. Rep. of Germany

[21] Appl. No.: 942,043

[22] Filed: Sep. 13, 1978

[30] Foreign Application Priority Data

Sep. 24, 1977 [DE] Fed. Rep. of Germany ..... 2743090

[51] Int. Cl.[3] ..... B22D 9/10

[52] U.S. Cl. ..... 264/8; 164/46; 164/52; 164/252; 164/348; 264/10; 425/8

[58] Field of Search ..... 164/46, 52, 252, 87, 164/427, 429; 264/5, 8, 10, 13; 425/6, 8

[56] References Cited

U.S. PATENT DOCUMENTS

| | | | |
|---|---|---|---|
| 1,915,201 | 6/1933 | Ragg | 425/8 |
| 2,129,702 | 9/1938 | Merle | 164/46 |
| 4,027,718 | 6/1977 | Lundgren | 164/46 |

FOREIGN PATENT DOCUMENTS

| | | | |
|---|---|---|---|
| 2528843 | 1/1976 | Fed. Rep. of Germany | 164/252 |

*Primary Examiner*—Gil Weidenfeld
*Assistant Examiner*—K. Y. Lin
*Attorney, Agent, or Firm*—Fisher, Christen & Sabol

[57] ABSTRACT

An apparatus is disclosed for manufacturing splat foils by disintegration and rapid solidification of metallic melts. The apparatus has a self-consuming electrode disposed above a rotatable counter electrode. Attached to the counter-electrode is a conical plate which is cooled by a fluid circulating through its interior. The application of electrical energy to the electrodes causes the self-consuming electrode to melt and drop melt droplets onto the rotating counter-electrode. Centrifugal force causes the melt droplets to fly off the counter-electrode and contact the conical plate at which point they are rapidly cooled to form thin foils. A housing surrounds the electrodes and conical plate to collect the cooled foils and to permit the apparatus to operate in an inert atmosphere, if desired.

18 Claims, 1 Drawing Figure

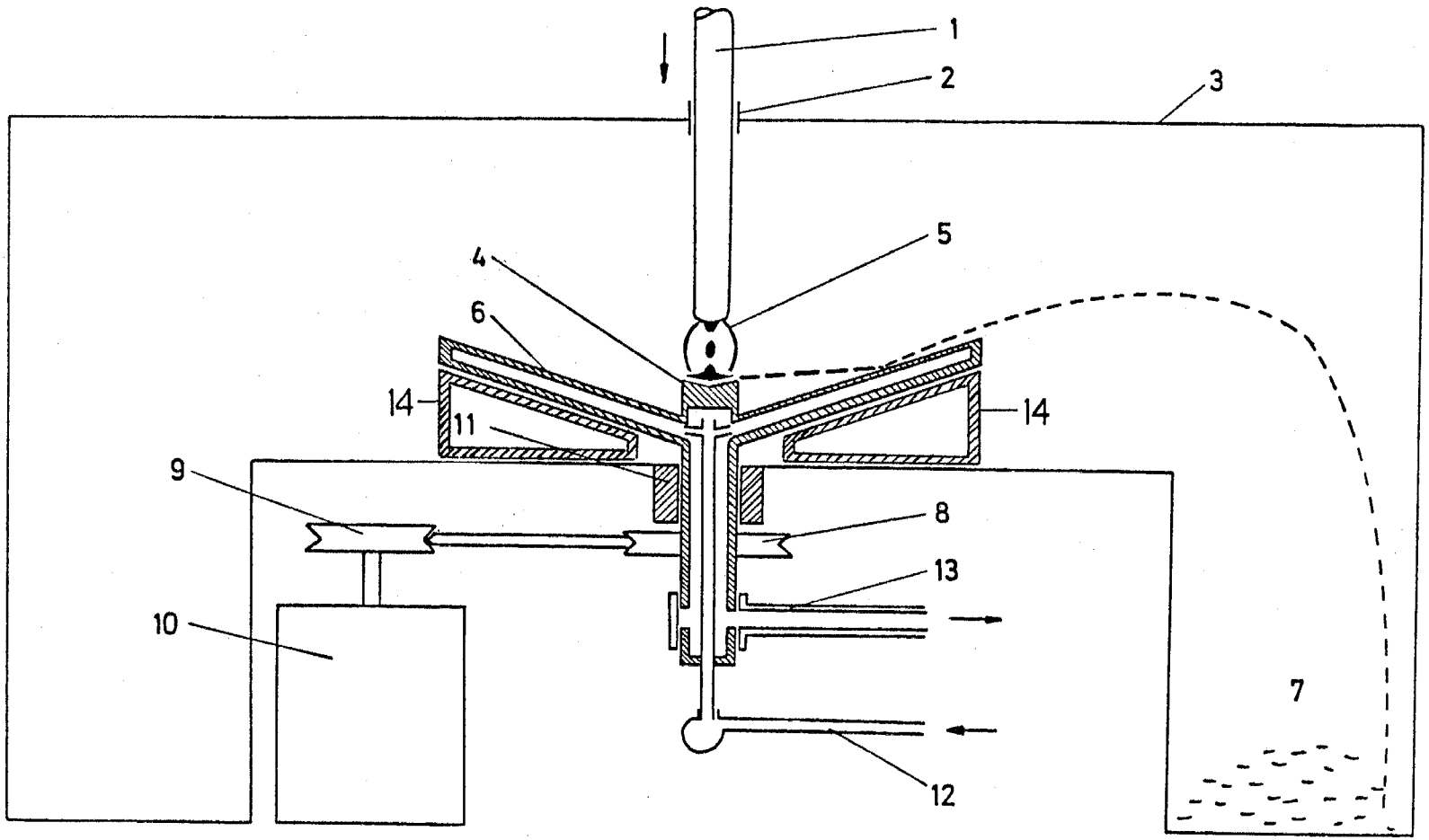
1
2
3
4
5
6
7
8
9
10
11
12
13
14
14

APPARATUS AND METHOD FOR THE MANUFACTURE OF SPLAT FOILS FROM METALLIC MELTS

FIELD OF THE INVENTION

The invention concerns a device and a method for the manufacture of splat foils by disintegration and rapid solidification of metallic melts.

BACKGROUND OF THE INVENTION

The increasing demand for rapidly solidified splat foils from metallic melts is accounted for by the fact that the high solidification rate ensures a very fine structure which is indispensable for optimum properties of the resulting material and for further processing. For example, a solidification rate of more than $10^5$ °C./s causes aluminium alloys containing a few weight percent iron to change from a brittle state with low corrosion resistance to a ductile and corrosion-resistant state with a high elevated-temperature strength. The known processes and devices do not, however, permit this alloy to be produced economically, since the proportion of coarser alloy particles which solidify at an inadequate rate is still too large to quarantee good properties of the resulting product.

The known atomizing processes for the rapid solidification of metallic melts produce only a small proportion of high-quality granulate having the optimum structure. Using a rotating perforated siphon, the melt particles are spun from the openings onto cooling plates where they spread into long, thin flakes or foils and rapidly solidify. The throughput achieved with this device is, however, not satisfactory. Furthermore, this method cannot be used in the processing of high temperature and aggressive melts, for instance on refractory metals such as titanium, vanadium, niobium, chromium, or on some superalloys of nickel or cobalt, since these melts react strongly with the material of the device at temperatures of around 1200° C. and higher. The same deficiencies exist in the atomizing processes which disintegrate the melt with a pressurized gas; either the pressurized gas or the materials in contact with the melt strongly react with it.

Additionally, processes are known which work either with (a) stationary or slowly moving cooling surfaces arranged concentrically at a particular angle to the trajectory of the incident melt droplets, or (b) a rapidly rotating cylinder in the axis of which the spray source is located. The latter arrangement leads to a heavy thermal load on narrow annular zones, as well as to the danger that the incident melt droplets adhere and form a thick structure of overlapping, fused particles of solidified melt. In addition, the centrifugal force presses the incident particles onto the interior wall of the rotating cylinder. This causes difficulties in the detachment and removal of the particles. Also, at the rotational speeds required for the production of thin splat foils, the use of cylinders of larger diameters results in an unbalanced state. This defect is intensified by the irregular distribution of the accumulated melt particles.

SUMMARY OF THE INVENTION

It is the object of the present invention to create a device for the production of splat foils by the rapid solidification of metallic melts, which complies with all requirements both in respect of throughput and also with regard to the desired high solidification rate, and in addition permits refractory melts to be processed at operating temperatures of up to 3500° C. without reactions with the materials with which the melt is in contact.

This object can be achieved in a very advanced technological way when the device is equipped with a rotationally symmetric peripheral conical plate, which is combined with the central plate, whose upper surface is a cooling surface, which the melt particles strike after being spun off of the central plate, and where they are stretched into foils and subsequently detached from the surface by centrifugal force and spun off.

The apparatus according to the invention has a central rotating plate and devices for feeding the metallic melt onto the central plate. In particular the device can be used to produce novel bearing alloys, aluminium-base alloys with a high lead content and copper-base alloys or refractory-metal-base alloys such as alloys of niobium or vanadium for the production of conductors and superconductors. Futhermore, lead alloys for storage batteries and zinc alloys for the production of roofings as well as aluminium-iron alloys of high strength at elevated temperature and high corrosion resistance, and amorphous alloys with a wide scope of novel properties can be produced.

Since the device according to the invention is contained in a closed housing, it is also possible, (in contrast to the known atomizing processes) to work in a vacuum or in a protective atmosphere.

The rotating conical plate is preferably made from copper and has a water-cooled hollow interior. This structure resists even high-temperature refractory metallic melts.

Great attention must be paid to the surface of the conical cooling plate. In many cases a galvanic coating with another metal, such as a layer of chromium, a few μm thick, is advantageous. Even the application of carbon black or titanium nitride produces good results. In most cases a polished copper surface, which is repolished after a certain time, is sufficient.

In one embodiment the conical plate has a cone angle between 120° and 170°.

When working in a protective gas atmosphere, additional gas movements are directed radially outwards. These enhance the detachment of the solidified melt particles occuring at the peripheral parts of the plate, i.e. where the melt droplets strike. This gas flow serves at the same time to further cool the particles that are spun off. The rotatable conical plate can be mounted in a bearing which makes it possible to achieve the required high rotational speeds in the range of about 6000 rpm. The heat of solidification transmitted from the melt droplets impinging on the conical plate is considerable, and rapid and intensive dissipation must therefore be ensured. According to the invention, this is achieved by two measures. In one embodiment, the conical plate is filled with a circulating coolant, e.g. water. At the high centrifugal acceleration involved the resulting steam then moves rapidly towards the rotational axis, and from there it can be led off, cooled, condensed and recirculated. At a moderate heat load this system works even if no steam is developed, but as an alternative embodiment, a fixed cooling block 14 can be installed as close as possible below the rotatable conical plate and filled, for example, with liquid nitrogen. In this case the required heat transfer is effected by radiation. Other features, advantages and possible applications of the invention result from the following explanation of further details based on the attached figure and the description of the embodiments.

BRIEF DESCRIPTION OF THE FIGURES

The FIGURE shows a simplified schematic drawing of a cross-section of the device according to the invention.

DETAILED DESCRIPTION OF THE PREFERED EMBODIMENTS

In the attached FIGURE, self-consuming electrode 1, made from the alloy material, is introduced into cylindrical housing 3 of the device according to the invention via aperture 2. Central plate 4 forms the counter-electrode. The melt droplets developing in electrical arc 5 are spun off rotating central plate 4 onto rotating conical plate 6, attached thereto, and are stretched there in both radial and tangential directions to form thin flakes or foils. Immediately after solidification, these foils become detached and are spun off into annular storage container 7. Central plate 4 and conical plate 6 are rotated using motor 10 via V-belts and pulleys 8 and 9. In addition, to ensure smooth rotation, bearing elements 11 are provided around the rotational axis.

Rapidly rotating conical plate 6 is hollow inside. Cooling water is introduced via feed pipe 12. Because of the high centrifugal acceleration, the resulting steam is forced towards the rotational axis in the form of bubbles and removed through nozzle 13. In case of a small heat load, heated water with its reduced specific weight is forced towards the rotational axis and removed through nozzle 13.

The rotating conical plate according to the invention can be adequately cooled by means of radiation onto a fixed blackened cooling block cooled by liquid nitrogen and positioned immediately below the plate. At higher melt throughputs water cooling is necessary, which essentially results in the release of a steam-water mixture. This can be condensed in a heat exchanger and recirculated. As a useful side-effect it has been found that the hollow plate filled with water is self-centering. If at high speeds melt particles get stuck, a redistribution of the cooling water results, which automatically offsets this and thus compensates for the state of imbalance.

Using this apparatus, even refractory metals and alloys, e.g. titanium-, vanadium- or niobium-base alloys, can be processed into rapidly solidified splat foils by working in a protective gas atmosphere at reduced presure, as it is known from the vacuum arc furnace. In this case surrounding housing 3 is a vacuum-tight container.

In the FIGURE, means for drawing a vacuum in housing 3 is indicated by numeral 15—vacuum means 15 communicates with housing 3 via line 16. In the FIGURE, means for providing an inert gas within housing 3 is indicated by numeral 17—means 16 communicates with housing 3 via line 18.

The following examples illustrate the present invention:

EXAMPLE 1

Using a device according to the invention, in which the diameter of the central plate was 50 mm, the diameter of the conical plate was 500 mm and the cone angle of the conical plate was 150°, an aluminium melt containing 8 weight percent iron and heated to 1100° C., was processed into splat foils with an optimum structure, i.e. homogeneous appearance under a light-optical microscope, using a rotational speed of 6000 rpm and a water throughput of 3 l/min. The throughput amounted to 10 kg/min. Processing was effected in an inert gas atmosphere (argon) at normal or reduced pressure. By additional water cooling of the walls of the housing surrounding the device, the temperature of the argon atmosphere in the housing can be considerably reduced. The argon assumes part of the task of removing the melt particles striking the rotating conical plate since it flows over the surface of the plate from the center towards the outer edge at great speed.

By compaction and extrusion, a semi-finished product with good mechanical properties was manufactured from the splat foils of the aluminium alloy containing 8 weight percent iron. The semi-finished product can be used at temperature of up to 300° C. and, because of its high corrosion resistance, is suitable for the production of pipes for seawater desalination plants.

EXAMPLE 2

A self-consuming electrode was produced from niobium with a diameter of 2 mm inside a copper tube with a total diameter of 5 mm. In the device according to the invention, in which the central plate forms the counter-electrode, up to 1 kg/min. of a copper alloy with 15 weight percent niobium in a fine dispersion was produced in the form of splat foils with shining surfaces, in an atmosphere of purified argon at a pressure of 100 torr.

After compaction and extrusion of the splat foils, wires were drawn having good superconducting properties. Additions of about 5 weight percent tin to this alloy resulted in a further increase in the superconducting properties of these wires. A transition temperature $T_c$ of 18.4 K was achieved, as well as a critical current density of $3.10^5$ A/cm$^2$ and a critical upper magnetic field strength of 450 kG. These wires exhibited high inherent stability and are suitable for use in superconducting power transmission lines and coils.

EXAMPLE 3

A self-consuming electrode with a diameter of 1 cm was produced by mixing and compacting 40 weight percent Fe, 40 weight percent nickel, 14 weight percent phosphorus and 6 weight percent boron, all in the form of powders. In the device according to the invention splat foils were produced in an argon atmosphere at a pressure of 100 torr. The resulting splat foils exhibited an amorphous structure and a high magnetic permeability. The splat foils were ground in a ball mill into a powder with a mean particle diameter of 50 $\mu$m from which shaped particles of high magnetic permeability were formed, preferably by the addition of a resinous binder.

I claim:

1. A method for making metallic splat foils comprising the steps of:

(a) producing molten metal droplets;

(b) directing said molten metal droplets onto a rotating plate;

(c) rotating said plate so as to cause said molten metal droplets to be discharged from said plate by centrifugal force; and (d) contacting said discharged molten metal droplets with a rotating cooling conical surface so as to rapidly solidify and stretch said molten metal droplets to form said splat foils, said splat foils being detached from the rotating conical surface by centrifugal force.

2. Apparatus for making splat foils by melting and rapidly solidifying a metallic material, said apparatus comprising:

(a) means for producing droplets of metal;

(b) a rotatable central plate upon which said metal droplets fall;

(c) a conical plate attached to said central plate so as to rotate therewith and located such that the metal droplets are spun off said rotating central plate, strike the upper surface of said conical plate, are rapidly solidified and stretched into foils, and are detached from the surface by centrifugal force;

(d) means to rotate said central plate and said conical plate; and (e) cooling means to cool the upper surface of said conical plate.

3. The apparatus as claimed in claim 2 wherein the conical plate has a cone angle between 120° and 170°.

4. The apparatus as claimed in claims 2 or 3 wherein said conical plate is hollow and further comprising means to circulate a cooling fluid in said hollow conical plate.

5. The apparatus as claimed in claim 4 wherein said cooling fluid is water.

6. The apparatus as claimed in claim 4 wherein said conical plate is made of copper.

7. The apparatus as claimed in claim 6 wherein said conical plate has a chromium coating at least on the surface contacted by said metal droplets.

8. The apparatus as claimed in claim 6 wherein said conical plate has a coating of carbon black on at least the surface contacted by said metal droplets.

9. The apparatus as claimed in claim 6 wherein said conical plate has a coating of titanium nitride on at least the surface contacted by said metal droplets.

10. The apparatus as claimed in claim 4 further comprising a housing surrounding said central and conical plates so as to contain and collect the solidified foils as they are spun off said conical plate.

11. The apparatus as claimed in claim 10 further comprising means to draw a vacuum within said housing.

12. The apparatus as claimed in claim 10 further comprising means to provide an inert gas protective atmosphere within said housing.

13. The apparatus as claimed in claim 2 wherein said means for producing droplets of metal comprises a first electrode made of a metallic material and wherein said central plate comprises a second electrode such that application of electrical energy to said electrodes causes said first electrode to melt and produce droplets of metal.

14. The apparatus as claimed in claim 4 wherein said means for producing droplets of metal comprises a first electrode made of a metallic material and wherein said central plate comprises a second electrode such that application of electrical energy to said electrodes causes said first electrode to melt and produce droplets of metal.

15. Apparatus for making splat foils by melting and rapidly solidifying a metallic material, said apparatus comprising:

(a) means for producing droplets of metal;

(b) a rotable central plate upon which said metal droplets fall;

(c) a conical plate attached to said central plate so as to rotate therewith and located such that the metal droplets are spun off said rotating central plate, strike the surface of said conical plate, are rapidly solidified and stretched into foils, and are detached from the surface by centrifugal force;

(d) means to rotate said central plate and said conical plate; and (e) a cooling block located immediately adjacent to said conical plate so as to remove heat radiated from said conical plate.

16. The apparatus as claimed in claim 15 wherein said cooling block is cooled by liquid nitrogen.

17. The apparatus as claimed in claim 15 wherein the conical plate has a cone angle between 120° and 170°.

18. Apparatus for making splat foils by melting and rapidly solidifying a metallic material, said apparatus comprising:

(a) means for producing droplets of metal;

(b) a rotable central plate upon which said metal droplets fall;

(c) a conical plate attached to said central plate so as to rotate therewith and located such that the metal droplets are spun off said rotating central plate, strike the surface of said conical plate, are rapidly solidified and stretched into foils, and are detached from the surface by centrifugal force;

(d) means to rotate said central plate and said conical plate; and (e) cooling means to remove heat radiated from said conical plate.

* * * * *